US006381996B1

(12) United States Patent
Chang

(10) Patent No.: US 6,381,996 B1
(45) Date of Patent: May 7, 2002

(54) DYEING MACHINE FABRIC GUIDE ARRANGEMENT

(76) Inventor: Chi-Lung Chang, PO Box 82-144, Taipei (TW)

( * ) Notice: Subject to any disclaimer, the term of this patent is extended or adjusted under 35 U.S.C. 154(b) by 0 days.

(21) Appl. No.: 09/497,635

(22) Filed: Feb. 3, 2000

(51) Int. Cl.[7] ..... D06B 3/28
(52) U.S. Cl. ..... 68/178
(58) Field of Search ..... 68/177, 178

(56) References Cited

U.S. PATENT DOCUMENTS 4,881,384 A * 11/1989 Chicharro ..... 68/178 X
4,896,516 A * 1/1990 Bene ..... 68/177 X

FOREIGN PATENT DOCUMENTS

DE 134878 * 3/1978 ..... 68/178
DE 2945942 * 5/1981 ..... 68/178
FR 1.277.549 * 10/1961 ..... 68/178

* cited by examiner

*Primary Examiner*—Philip R. Coe
(74) *Attorney, Agent, or Firm*—A & J

(57) ABSTRACT

A dyeing machine fabric guide arrangement having a plurality of shafts respectively installed in the housing of a dyeing machine above a respective dye vat, a plurality of fabric guide rings respectively mounted on the shafts for guiding a respective fabric through a respective dye vat in the housing, and a plurality of hand wheels respectively fixedly fastened to the shafts outside the housing for enabling the operator to rotate the shafts and to change the angular position of the fabric guide rings respectively, so as to further adjust the tension of the respective fabrics passing through the fabric guide rings.

1 Claim, 5 Drawing Sheets

DYEING MACHINE FABRIC GUIDE ARRANGEMENT

BACKGROUND OF THE INVENTION

The present invention relates to a dyeing machine, and specifically to a dyeing machine fabric guide arrangement, in which angular-adjustable fabric guide rings are provided to guide fabrics through a respective dyeing vat, and respectively turned to a respective angular position to adjust the tension of the respective fabrics subject to their thickness.

In a dyeing machine, fabrics are continuously moved through respective dyeing vats, and dyeing liquor is driven out of spray nozzles toward fabrics, enabling moving fabrics to be well dyed in the respective dyeing vats. In order to keep smooth circulation of fabrics through the respective dyeing vats, fabric guide rings are commonly used and fixedly installed in the dyeing machine to guide respective fabrics. In order to achieve a satisfactory dyeing effect, fabrics of different thickness require different tension when passing through the respective dyeing vats. However, because the fabric guide rings have a fixed size, they cannot fit different fabrics having different thickness. Further, in case the dyeing operation in one dyeing vat encounters a trouble, the dyeing machine should be shut down, for enabling the trouble to be eliminated.

SUMMARY OF THE INVENTION

It is one object of the present invention to provide a fabric guide arrangement for a dyeing machine, which has fabric guide means to guide circulation of respective fabrics through respective dyeing vats. It is another object of the present invention to provide a fabric guide arrangement for a dyeing machine, which has means for enabling respective fabric guide means to be respectively adjusted to change the tension of respective fabrics subject to the thickness of respective fabrics. To achieve these and other objects of the present invention, there is provided a dyeing machine fabric guide arrangement comprising a plurality of shafts respectively installed in the housing of a dyeing machine above a respective dye vat in the housing, a plurality of fabric guide rings respectively fixedly mounted on the shafts inside the housing for guiding a respective fabric through a respective dye vat in the housing, and a plurality of hand wheels respectively fixedly fastened to the shafts outside the housing for enabling the operator to rotate the shafts and to change the angular position of the fabric guide rings respectively, so as to further adjust the tension of the respective fabrics passing through the fabric guide rings.

DETAILED DESCRIPTION OF THE PREFERRED EMBODIMENT

Figure 1:
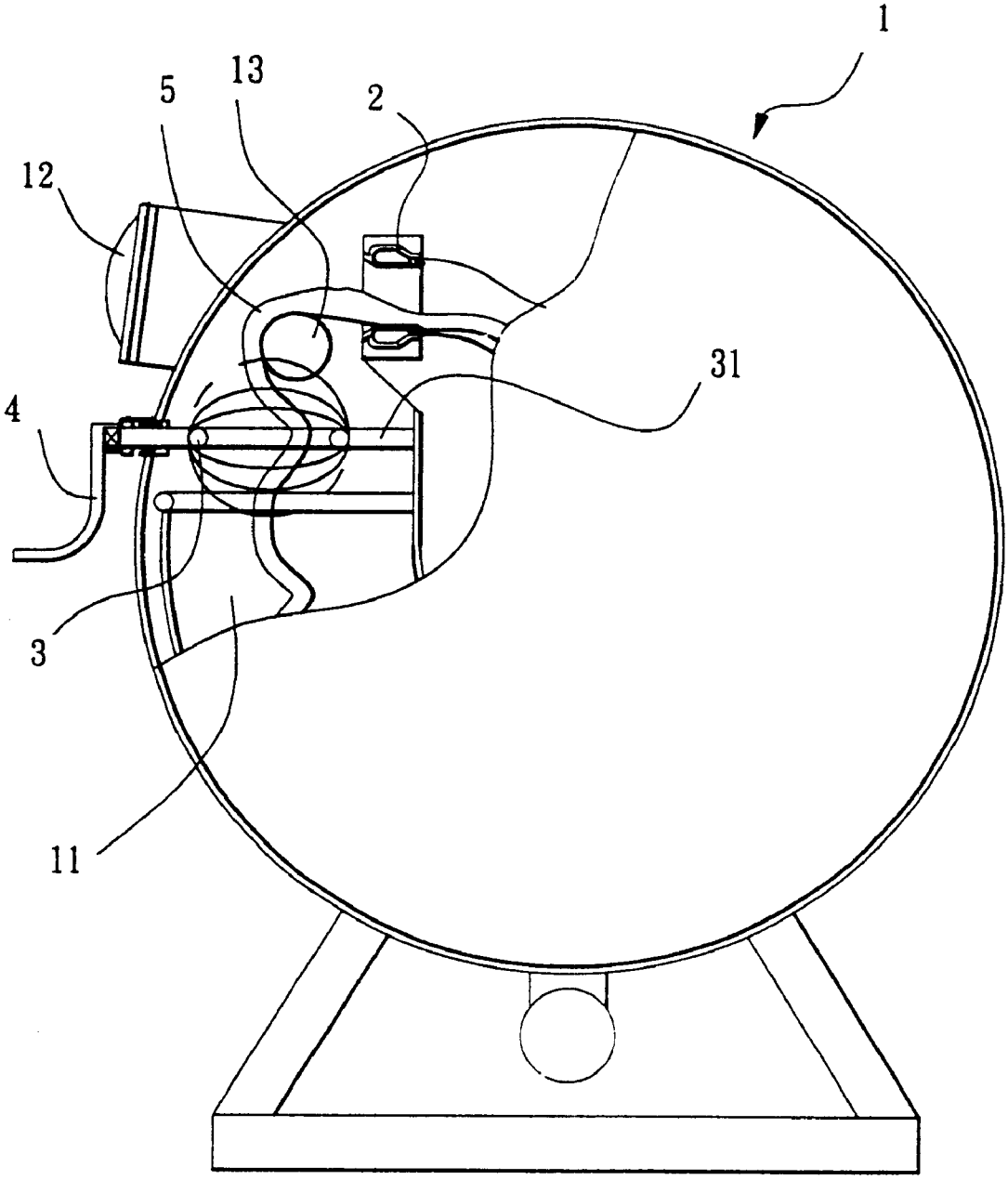
FIG. 1 is a sectional side plain view of a dyeing machine according to the present invention.
Figure 2:
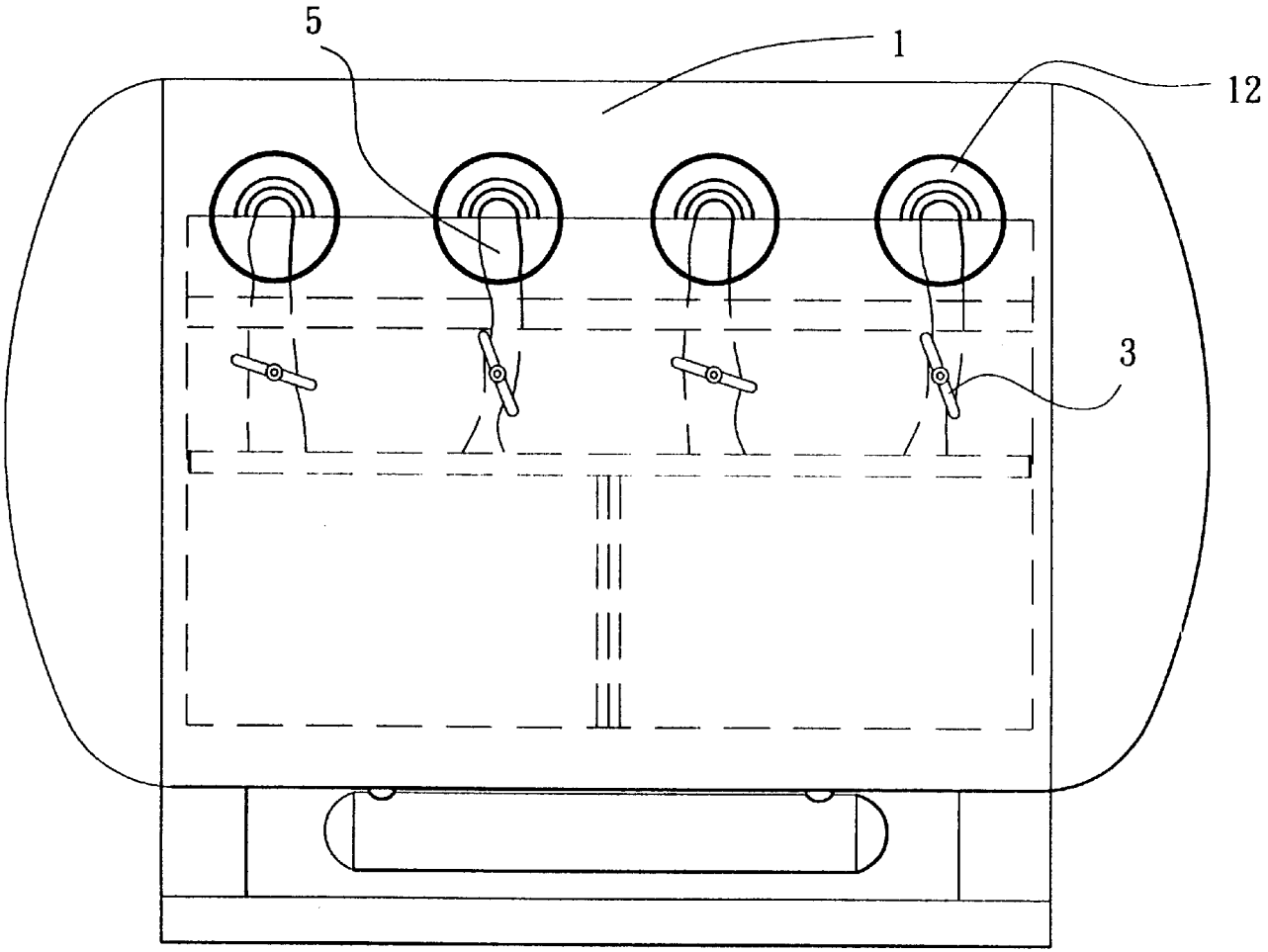
FIG. 2 is sectional front plain view of the dyeing machine shown in FIG. 1.

Referring to FIGS. from 1 through 5, a dyeing machine is shown comprising a housing 1 defining a plurality of dye vats 11 (which can be shaped like a trough or tube), a fabric guide roll 13 horizontally mounted inside the housing 1 above the dye vats 11, a plurality of spray nozzles 2 respectively disposed inside housing 1 above the dye vats 11 and controlled to spray a dyeing liquor toward the fabrics 5 passing through the dye vats 11, a plurality of visual windows 12 at the front side of the housing 1 near the top corresponding to the dye vats 11, a plurality of shafts 31 suspended above the dye vats 11 below the fabric guide roll 13 and respectively extended out of the front side of the dyeing machine 1 below the operation door 12, a plurality of fabric guide rings 3 respectively mounted on the shafts 31 inside the housing 1, and a plurality of hand wheels 4 respectively fastened to the shafts 31 outside the housing 1. The connection area between the front side of the housing 1 and the shafts 31 are well sealed with sealing means to prevent a leakage. Fabrics 5 are respectively arranged inside the housing 1 and inserted through the fabric guide rings 3 and the dye vats 11. During dyeing operation, the fabrics 5 are continuously moved through the dye vats 11, and dyeing liquor is driven out of the spray nozzles 2 toward the fabrics 5. When passing through the dye vats 11, the fabrics 5 are well dyed by the dyeing liquor accumulated in the respective dye vats 11. Before dyeing, the hand wheels 4 are operated to rotate the respective shafts 31, so as to adjust the angular positions of the respective fabric guide rings 3 subject to the thickness of the respective fabrics 5.

Figure 3A:
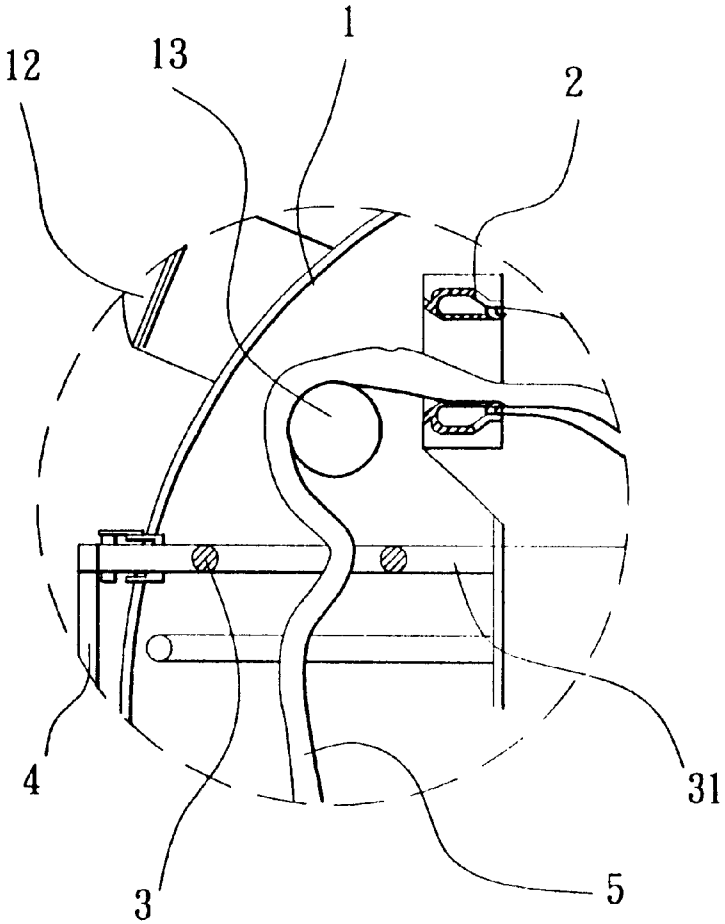
FIG. 3A is an enlarged view of a part of FIG. 1, showing a fabric passed through a fabric guide ring.
Figure 3B:
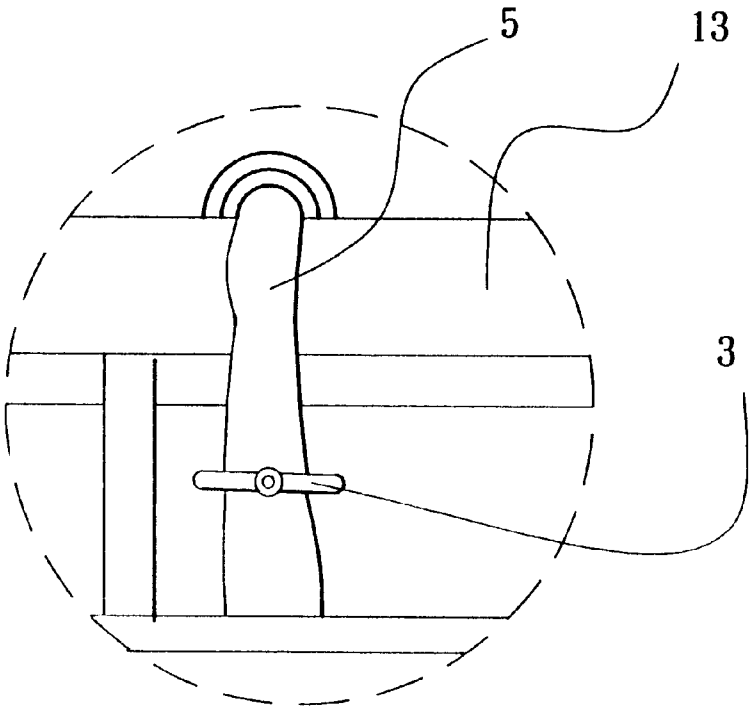
FIG. 3B is a front view of FIG. 3A.
Figure 4A:
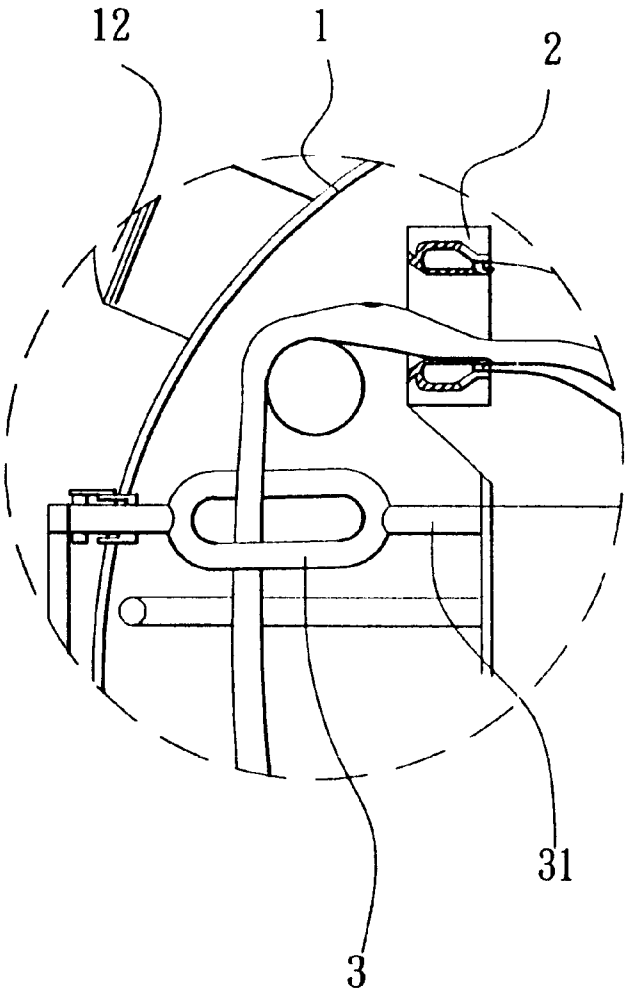
FIG. 4A is similar to FIG. 3A but showing the angular position of the fabric guide ring adjusted.
Figure 4B:
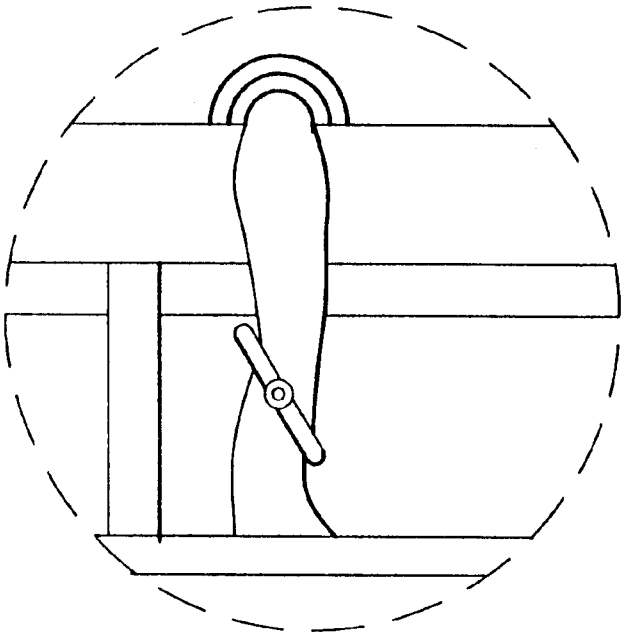
FIG. 4B is a front view of FIG. 4A.
Figure 5A:
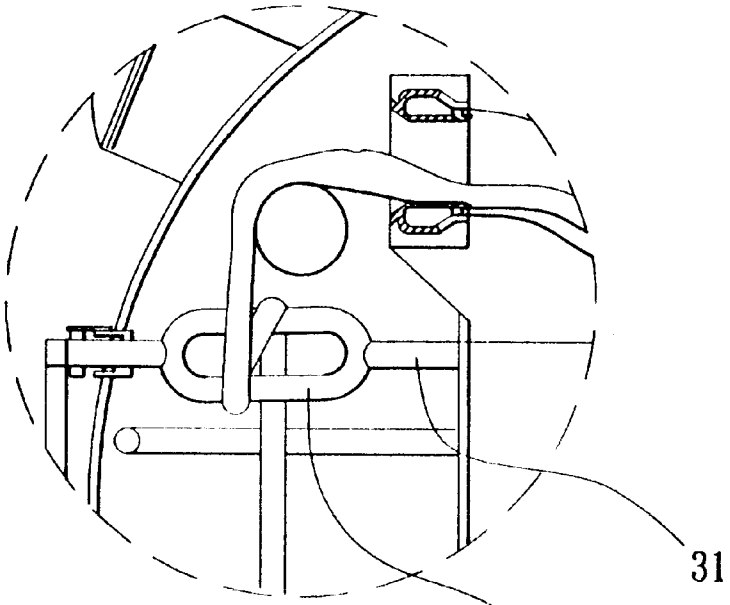
FIG. 5A is similar to FIG. 4A but showing the angular position of the fabric guide ring adjusted again, the fabric twisted.
Figure 5B:
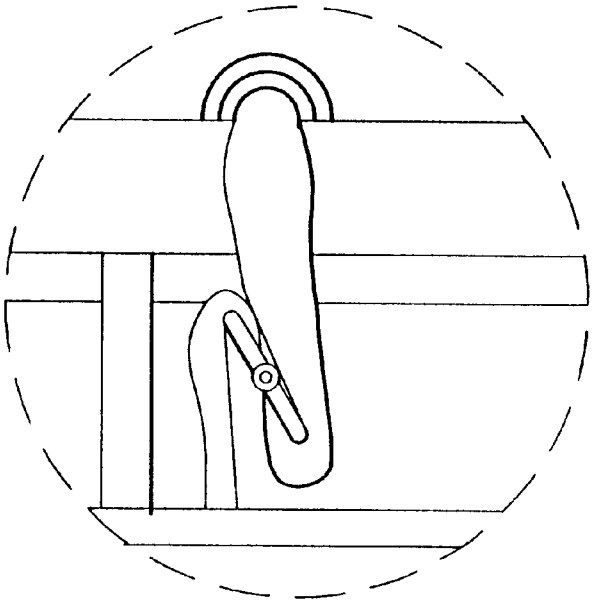
FIG. 5B is a front view of FIG. 4A.

Referring to FIGS. 3A and 3B again, when the fabric guide ring 3 is adjusted to a horizontal position, it simply guides the movement of the fabric 5, and the maximum fabric guide range is provided at this stage. When the fabric guide ring 3 is rotated through an angle from the horizontal position to a tilting position, the fabric guide range becomes relatively smaller (because the horizontal cross section is relatively reduced), and the fabric 5 is switched to produce a tension, and the intensity of the tension varies with the angle of the fabric guide ring 3 (see FIGS. 4A and 4B). When the angular position of the fabric guide ring 3 is changed through 360°, the fabric 5 is twisted and lifted (see FIGS. 5A and 5B). Through the visual windows 12, the operator can check the process of the dyeing operation of the respective fabrics 5 visually. Because a respective guide ring 3 guides each fabric 5, when the dyeing operation in one dye vat 11 encounters a trouble, the dyeing operation in the other dye vats 11 can still be continued.

It is to be understood that the drawings are designed for purposes of illustration only, and are not intended for use as a definition of the limits and scope of the invention disclosed.

What the invention claimed is:

1. A dyeing machine fabric guide arrangement comprising a housing defining a plurality of dye vats, a fabric guide roll horizontally mounted inside the housing above the dye vats, a plurality of spray nozzles respectively disposed inside the housing above the dye vats and controlled to spray a dyeing liquor toward fabrics passing through the dye vats, a plurality of visual windows at a front side of the housing near a top corresponding to the dye vats, a plurality of shafts suspended above the dye vats below the fabric guide roll and respectively extended out of a front side of the dyeing machine below an operation door, a plurality of fabric guide rings respectively mounted on the shafts inside the housing, and a plurality of hand wheels respectively fastened to the shafts outside the housing, connection area between the front side of the housing and the shafts being well sealed with sealing means to prevent a leakage, the fabrics being respectively arranged inside the housing and inserted through the fabric guide rings and the dye vats, whereby during dyeing operation; the fabrics are continuosly moved through the dye vats, and the dyeing liquor is driven out of the spray nozzles toward the fabrics, and when passing through the dye vats, the fabrics are well dyed by the dyeing liquor accumulated in the respective dye vats, and before dyeing, the hand wheels are operated to rotate the respective shafts, so as to adjust angular positions of the respective fabric guide rings subject to thickness of the respective fabrics.

* * * * *